US005681401A

United States Patent [19]

Gardner et al.

[11] Patent Number: 5,681,401

[45] Date of Patent: Oct. 28, 1997

[54] MICROPHONE WASH ARM SENSOR

[75] Inventors: Douglas W. Gardner, Newton; Christopher C. Froah, Iowa City, both of Iowa

[73] Assignee: Maytag Corporation, Newton, Iowa

[21] Appl. No.: 577,189

[22] Filed: Dec. 22, 1995

[51] Int. Cl.[6] ..... B08B 3/02

[52] U.S. Cl. ..... 134/18; 134/57 D; 134/113; 134/25.2

[58] Field of Search ..... 68/56 R, 56 D, 68/57 D, 58 D, 113, 198, 12.02; 137/551; 134/18, 25.2, 34

[56] References Cited

U.S. PATENT DOCUMENTS

| | | | |
|---|---|---|---|
| 1,154,386 | 9/1915 | Delany . | |
| 3,279,481 | 10/1966 | Sones et al. | 134/57 |
| 3,949,366 | 4/1976 | Spillar et al. | 340/171 R |
| 4,479,115 | 10/1984 | Holzhauer | 340/611 |
| 4,502,041 | 2/1985 | Penzien | 340/532 |
| 4,509,543 | 4/1985 | Livingston et al. | 134/57 |
| 4,692,754 | 9/1987 | Edejer et al. | 340/671 |
| 4,913,690 | 4/1990 | DiGiacomo et al. . | |
| 5,131,419 | 7/1992 | Roberts | 134/50 |
| 5,229,753 | 7/1993 | Berg et al. | 340/679 |
| 5,272,892 | 12/1993 | Janutka et al. . | |
| 5,287,884 | 2/1994 | Cohen . | |
| 5,385,168 | 1/1995 | Lund . | |
| 5,409,037 | 4/1995 | Wheeler et al. . | |

OTHER PUBLICATIONS

Electrical, Dec. 28, 1976.
Offical Gazette, Aug. 17.

*Primary Examiner*—Frankie L. Stinson
*Attorney, Agent, or Firm*—Zarley, McKee, Thomte, Voorhees & Sease

[57] ABSTRACT

A sensor is provided for sensing operational characteristics of a dishwasher. The sensor includes a microphone mounted within the door of the dishwasher. The microphone is connected through electrical circuitry to a microprocessor mounted within the door. The microphone is adapted to generate a signal in response to impingement of water from the rotating wash arms upon the inside of the door. The signal is sent to the microprocessor, which converts the signal into information regarding the rotational velocity of the wash arm. This information is processed to control the operational parameters of the dishwasher.

15 Claims, 2 Drawing Sheets

MICROPHONE WASH ARM SENSOR

BACKGROUND OF THE INVENTION

Conventional dishwashing machines include one or more rotatable wash arms which provide a spray of water to wash and rinse items, such as dishes, glasses, and utensils, contained in racks so as to clean the items. During operation of the dishwashing machine, visual observation of the operation is not possible, since the dishwashing machine door is closed. Therefore, it is difficult to determine whether the machine is operating properly, and particularly whether the rotatable wash arms are functioning properly. Without such a determination, the operation of the machine cannot be analyzed, except by stopping the machine or waiting until the wash operation is completed and inspecting the items being washed in the machine.

Accordingly, a primary objective of the present invention is the provision of an improved dishwashing machine wherein the operation of the machine can be quickly and easily analyzed.

Another objective of the present invention is the provision of a means and method for analyzing the operation of the dishwashing machine.

A further objective of the present invention is the provision of a microphone and associated electronic circuitry for unobtrusively detecting operational parameters of the dishwashing machine.

Another objective of the present invention is a sensor for sensing the operational characteristics of a dishwashing machine, such as wash arm blockage, washing chamber water level, and pump starvation.

A further objective of the present invention is the provision of a microphone and microprocessor controller in a dishwashing machine for sensing and analyzing operating parameters of the machine.

Another objective of the present invention is the provision of a device for sensing wash arm rotation in a dishwashing machine which is economical to manufacture, and durable and accurate in use.

These and other objectives will become apparent from the following description of the invention.

SUMMARY OF THE INVENTION

The present invention utilizes a microphone and a microprocessor based controller mounted within the door of a dishwashing machine to analyze certain operational parameters or characteristics of the machine. More particularly, a pair of microphones are housed between the inner and outer door panels at elevations substantially level with the spray of water onto the door from the wash arms of the dishwasher. The microphones are operatively connected to a microprocessor based controller through electronic circuitry, including a conditioning circuit and an amplifying circuit. The microphones generate a signal in response to the flow of water from the rotating wash arms. The signal is conditioned and amplified, and then received by the microprocessor based controller which converts the signal into information regarding the rotational velocity of the wash arms. This information is then processed by the microprocessor based controller to control operational characteristics of the dishwasher.

DETAILED DESCRIPTION OF THE DRAWINGS

Figure 1:
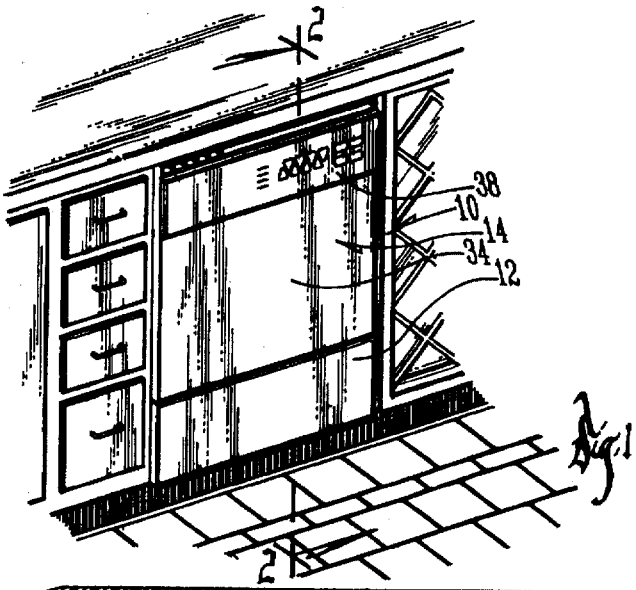
FIG. 1 is a perspective view of a dishwasher mounted beneath a countertop.

With reference to the drawings, the numeral 10 generally designates a dishwasher. The dishwasher 10 has a cabinet 12 and a door 14 which is movable between open and closed positions. The cabinet defines a washing chamber 16. An upper rack 18 and a lower rack 20 are mounted within the washing chamber 16 and are adapted to contain items to be washed, such as dishes, bowls, glasses, and utensils. A water pump 22 and a heating element 24 are operatively mounted within the washing chamber 16. An upper wash arm 26 and a lower wash arm 28 are rotatably mounted within the washing chamber 16, and are adapted to receive water from the pump 22, such that a plurality of jets or streams of water 30 can be sprayed from each wash arm 26 or 28 onto the items contained within the racks 18 and 20. The door 14 includes an inner panel 32 and an outer panel 34, with a space 36 therebetween. The door 14 also includes a control panel 38 which houses the controls including a microprocessor based controller 42 which control the operation of the dishwasher 10.

The structural elements of the dishwasher 10 described above are conventional, and do not constitute a part of the present invention. The invention is directed towards a means and method for sensing operational characteristics of the dishwasher.

Figure 2:
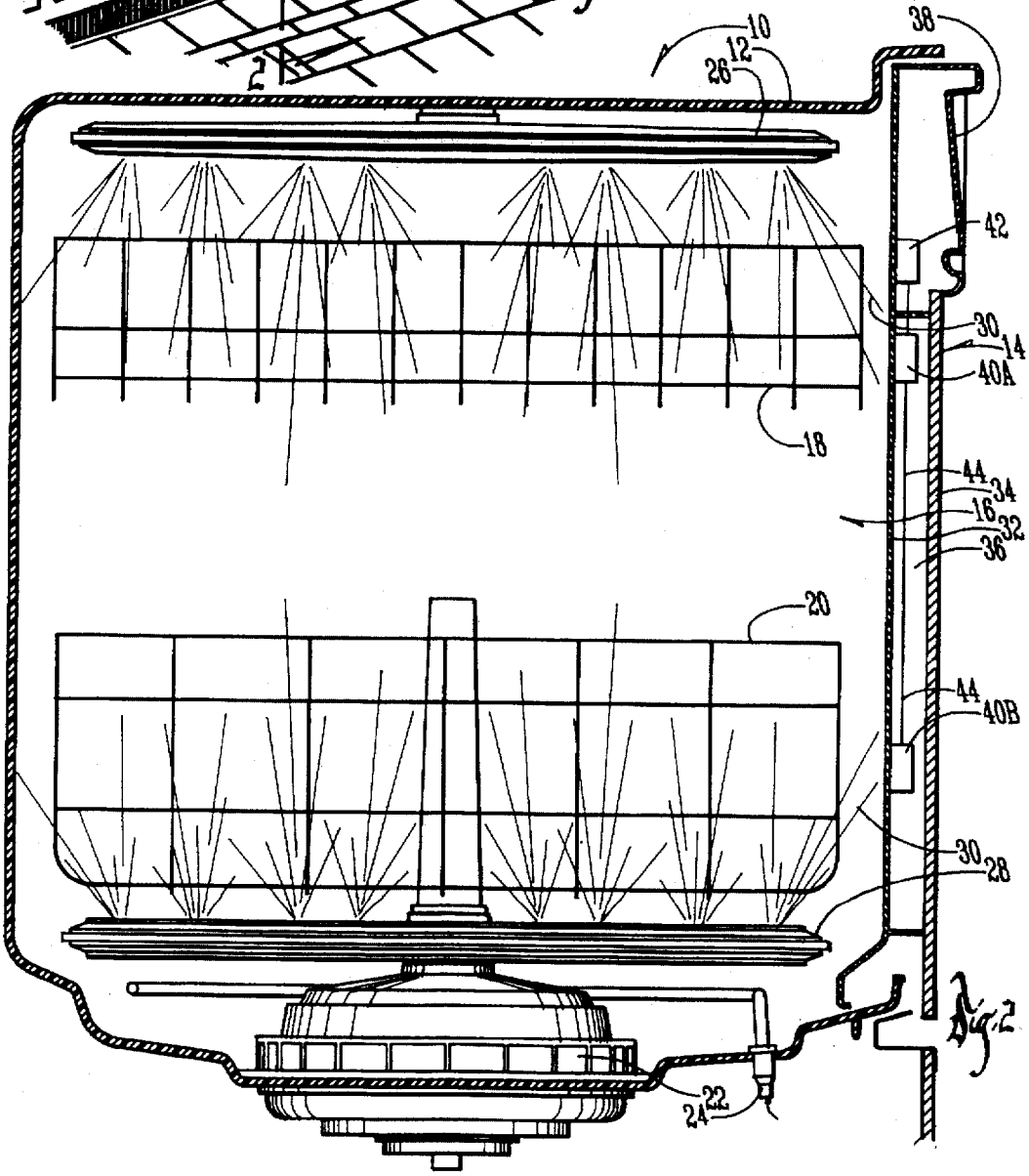
FIG. 2 is a sectional view of the dishwasher taken along lines 2—2 of FIG. 1 showing the microphone sensor of the present invention.
Figure 3:
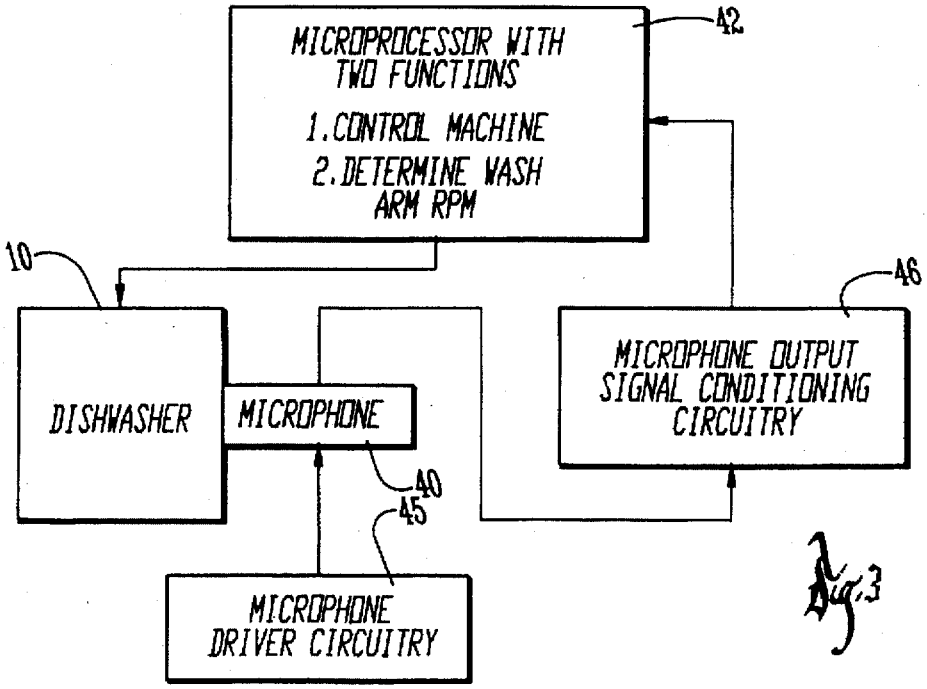
FIG. 3 is a schematic flow chart showing the operation of the present invention.

More particularly in one embodiment, the sensor system of the present invention includes at least one microphone 40 mounted within the space 36 between the door panels 32, 34, and adjacent to the inner door panel 32. Preferably, a pair of microphones 40 are utilized, as shown in FIG. 2. The upper microphone 40A is positioned at an elevation substantially level with the impingement of the water stream 30 from the upper wash arm 26 onto the inner panel 32 of the door 14, and the lower microphone 40B is positioned adjacent the impingement of the water stream 30 from the lower wash arm 28 upon the inner surface of the inner door panel 32. The microphones 40A and 40B are operatively connected to a microprocessor based controller 42 through electrical circuitry 44. While microphones 40A and 40B have been shown located in the space 36 between door panels 32 and 34, they could be mounted anywhere around the periphery of the dishwasher 10. Also, the microphones 40A and 40B have been described as detecting the direct impingement of water streams 30 upon the door panel 32. It is known that the microphones 40A and 40B can detect the water streams 30 without the streams 30 actually impinging on the door panel 32. The term "microphone" as used herein refers to an acoustic/electrical transducer that produces an electrical signal in response to acoustic energy, and in particular, the acoustic energy generated by the impingement of wash water streams in a dishwasher. One microphone that has provided satisfactory operation is a Panasonic model WM-54BT electret condenser microphone cartridge.

Figure 4:
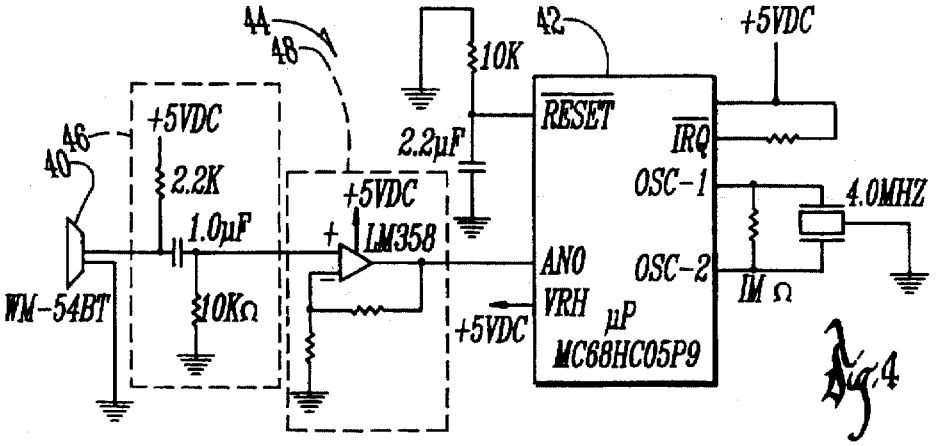
FIG. 4 is an electrical schematic of the sensor of the present invention.
Figure 5:
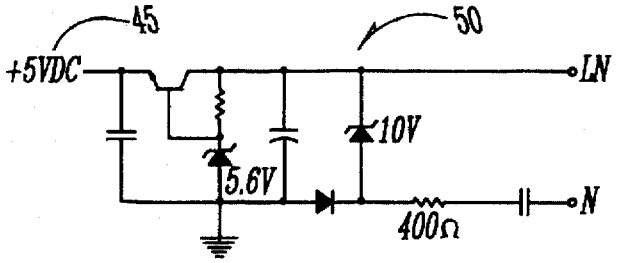
FIG. 5 is an electrical schematic of the power supply for the sensor.

The schematics for the electrical circuitry 44 are shown in FIGS. 4 and 5. The circuitry 44 includes a microphone driver circuit 45 comprising the 5 VDC output of power supply 50, a conditioning circuit 46 and an amplifying circuit 48. A preferred microprocessor controller 42 is commercially available from Motorola, model MC68HC05P9. The microprocessor based controller 42 also has conventional electrical components operatively connected thereto, as seen in FIG. 4, to allow the microprocessor based controller 42 to function.

FIG. 5 shows an electrical schematic for the power supply 50 which provides power to drive the microphone 40 and to energize the microprocessor based controller 42. The power supply circuitry 50 includes a transistor, capacitors, resistors, and diodes.

In operation, the microphones 40A and 40B and the microprocessor based controller 42 function to sense certain operational characteristics of the dishwasher 10. More particularly, the microphones 40A and 40B each generate a signal in response to impingement of water from the spray jets 30 onto the interior surface of the inner door panel 32. The conditioning circuit 46 conditions the signal, for example by filtering to eliminate noise. The signal is amplified by the amplifying circuit 48 prior to receipt by the microprocessor based controller 42. The microprocessor based controller 42 converts the conditioned and amplified signal from the microphones 40A and 40B into data or information about the rotational velocity of the respective wash arms 26 and 28. This rotational velocity information is then processed to control the operation of the dishwasher 10.

For example, when insufficient water is sprayed from one or both of the wash arms 26, 28, the rotational speed of the respective wash arm will be reduced, thereby reducing the frequency of impact of the water spray 30 upon the interior surface of the inner door panel 32. Such a reduced frequency of water impacting on the inner door panel 32 can result from one or more sources. First, the apertures in the wash arm through which the water is sprayed may be clogged. Secondly, there may be pump starvation due to clogging of the filter (not shown) in the pump 22 due to foaming from high protein food soils or low quality detergent. Thirdly, there may be insufficient water levels within the washing chamber 16 as a result of poor installation, low household water pressure, improper installation of the water level float (not shown) or blockage of the float by articles being washed. If the microprocessor based controller 42 senses such a reduced velocity of either of the wash arms 26, 28, the microprocessor based controller 42 can send a signal to initiate drainage of the washing chamber 16, after which a wash cycle can be restarted under normal conditions. Alternatively, the microprocessor based controller 42 can add water to correct an insufficient water level problem with the additional quantity added possibly being determined by the history of the dishwasher 10.

In another example, a utensil, such as a knife or fork, may move partially upwardly through the rack 18 or downwardly through the rack 20 so as to block rotation of either of the wash arms 26, 28. Such a blockage of the wash arm rotation changes the impingement of the water spray 30 upon the inner surface of the inner panel 32. In this example, the microprocessor based controller 42 can send a display signal to the control panel 38, which produces a visual or audible signal to a person to notify that there is a blocked wash arm problem that can be corrected by stopping operation of the dishwasher 10, opening the door 14, and moving the obstructive utensil.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A sensor for sensing operational characteristics of a dishwasher having a washing chamber with an access opening, a door movable between open and closed positions relative to the access opening to complete the washing chamber, and a rotatable wash arm mounted within the washing chamber for spraying water onto objects in the washing chamber when the door is in the closed position, the sensor comprising:

a microphone on an outer surface of the washing chamber and being adapted to generate a signal in response to the flow of water from the rotating wash arm;

a microprocessor operatively connected to the microphone for converting the signal into rotational velocity information of the wash arm and processing the rotational velocity information to control operational parameters of the dishwasher.

2. The sensor of claim 1 further comprising electronic circuitry for conditioning the signal generated by the microphone.

3. The sensor of claim 2 wherein the electronic circuitry filters the signal.

4. The sensor of claim 2 further comprising amplifying circuitry for amplifying the signal.

5. The sensor of claim 2 when the circuitry further comprises microphone drive circuitry for driving the microphone.

6. The sensor of claim 1 wherein the microphone is housed within the door and generates a signal in response to impingement of water from the rotating wash arm upon an inner surface of the washing chamber.

7. The sensor of claim 6 wherein the microphone is mounted within the door at an elevation substantially level with a spray of water from the wash arm of the dishwasher onto the door.

8. A method of sensing operational characteristics of a dishwasher, the dishwasher having a washing chamber with a rotatable wash arm therein for spraying water onto objects in the washing chamber, the washing chamber having an access opening to complete the washing chamber, and a door movable between open and closed positions relative to the access opening, the method comprising:

generating a signal in response to the flow of water from the rotating wash arm;

converting the signal into rotational velocity data of the wash arm;

processing the rotational velocity data to analyze operational characteristics of the dishwasher.

9. The method of claim 8 wherein the operational characteristics include at least one of wash arm blockage, washing chamber water level, and pump starvation.

10. The method of claim 8 wherein the signal is generated by a microphone housed within the door.

11. The method of claim 8 wherein the signals are converted by a microprocessor.

12. The method of claim 8 wherein the data is analyzed by a microprocessor.

13. The method of claim 8 further comprising conditioning of the signals prior to conversions to the data.

14. The method of claim 13 wherein the conditioning of the signals includes filtering.

15. The method of claim 8 further comprising amplifying the signal prior to converting the signal.

* * * * *